United States Patent [19]

Black, Sr. et al.

[11] 4,208,837

[45] Jun. 24, 1980

[54] WINDOW GUARD HAVING BOXED RELEASE

[75] Inventors: William R. Black, Sr.; Gerald L. Sams, both of Fort Worth, Tex.

[73] Assignee: Alvis Neely, Fort Worth, Tex.

[21] Appl. No.: 951,724

[22] Filed: Oct. 16, 1978

[51] Int. Cl.[2] ..... E06B 9/02; E05C 3/28

[52] U.S. Cl. ..... 49/56; 49/67; 49/141; 49/379; 49/394; 292/216; 292/229; 292/DIG. 37

[58] Field of Search ..... 49/56, 67, 141, 394, 49/379; 292/DIG. 37, 129, 229, 106, 207, 216

[56] References Cited

U.S. PATENT DOCUMENTS

| | | | |
|---|---|---|---|
| 1,185,422 | 5/1916 | Mammelli | 292/DIG. 37 UX |
| 2,086,034 | 7/1937 | Jacobi | 292/DIG. 37 UX |
| 2,680,639 | 6/1954 | Vigmostad | 292/129 X |
| 2,705,884 | 4/1955 | Craig | 292/DIG. 37 UX |
| 3,040,555 | 6/1962 | Wartian | 292/129 X |
| 3,451,702 | 6/1969 | Little | 49/379 X |
| 3,690,132 | 9/1972 | Engstrom | 292/DIG. 37 X |
| 3,921,334 | 11/1975 | Black, Sr. | 49/56 |
| 4,055,360 | 10/1977 | Russi | 49/56 X |
| 4,057,935 | 11/1977 | Rohrberg et al. | 49/56 |
| 4,070,048 | 1/1978 | Young | 49/141 X |

*Primary Examiner*—Philip C. Kannan
*Attorney, Agent, or Firm*—Wofford, Fails & Zobal

[57] ABSTRACT

Guard apparatus for a window or the like in a building characterized by a guard element that is hingedly mounted to a wall adjacent the window and adapted to prevent entry into the window from the exterior and having a releasable fastener that is releasable interiorly of the building without tools to allow emergency egress through the window but resists force exteriorly of the building. The releasable fastener has a lock housing that is inaccessible from outside the building when the lock bar on the guard element is inserted into its normal latched position. Also disclosed are specific structural details and preferred embodiments of the releasable fastener.

4 Claims, 5 Drawing Figures

WINDOW GUARD HAVING BOXED RELEASE

BACKGROUND OF THE INVENTION

1. Field of the Invention

This invention relates to guard, or security, apparatus for a window or the like in a building. More particularly, it relates to guard apparatus that prevents ingress through the window or the like, but allows emergency egress.

2. Description of the Prior Art

The prior art has seen a wide variety of window guards, shutters and the like to prevent entry, or ingress, through a window, doorway, or the like. The prior art guard apparatuses have not been totally satisfactory, since they suffered from one or more of a plurality of disadvantages as follows. Some of the prior art have completely blocked both egress and ingress and caused injury and death to people on the inside who are unable to escape in the event of a fire or the like. Others, such as shutters, where fastened in the middle and were easily opened by burglars or others who sought entry through the aperture guarded by the shutters. Still others had hinges that were easily disassembled to allow entry into the building. Attempts to foil the would be burglar by employing hooks and the like has proved unsatisfactory. On the other hand, when bolts with nuts screwed on the inside were employed, an excessive amount of time has been necessary to release the guard apparatus in the event of an emergency. Moreover, the nuts required tools to be normally operable by women and children and tended to become rusted or painted in place such that tools were always required for interior release; and the tools frequently were not available in an emergency.

Typical U.S. patents that have been issued in this field that are pertinent to this apparatus are the following U.S. Pat. Nos.:

810,923; 1,977,165; 2,024,871; 2,749,164; 3,921,334.

The latter patent was distinguished over the priorly listed ones during its prosecution. It represented a significant improvement in the state of the art but was not totally satisfactory in that it required more expensive installation in penetrating through the walls and the like than was deemed necessary. Moreover, the recess of the latch means interiorly of the walls was frequently unsightly to the decor interiorly of the building or the like.

Thus, it can be seen that the prior art apparatus was not totally satisfactory in providing a guard for a window or the like yet prevented burglarly, robbery, or unwanted ingress. Yet, the need for such security apparatus is more dramatic and urgent today than in this nation's history; particularly, it is urgent in the crime ridden, disadvantaged areas of today's cities.

SUMMARY OF THE INVENTION

Accordingly, it is an object of this invention to provide a guard for a window or the like in a building that obviates the disadvantages of the prior art and provides a guard element that prevents ingress, yet allows egress by a person on the interior of the building in the event of an emergency.

It is also an object of this invention to provide a guard element that effects the foregoing object and additionally can be opened by a woman or child without requiring tools or the like and that does not have an unsightly latch or the like interiorly of the building so as to mar the decor in a room interiorly of the building.

These and other objects will become apparent from the discriptive matter hereinafter, particularly when taken in conjunction with the drawings.

In accordance with this invention there is provided a guard for a windor or the like in a building comprising:

a. a guard element traversing the length and width of the window and being adapted to prevent entry into the window from the exterior of the building;

b. hinged mounting means hingedly mounting the guard element adjacent one of its edges onto a wall adjacent the window for pivotal movement of the guard element outwardly to provide emergency egress through the window;

c. releasable fastening means connected with the guard element at another of its edges and operable to hold the guard element closed against ingress into the building in normal position. The releasable fastening means includes a lock bar means for locking the guard element closed; the lock bar means being connected with the guard element and lockably positionable within a lock housing. The releasable fastening means also includes a lock housing that is connected with the building and has interiorly thereof a latch means for locking the lock bar into its normal position. The latch means is inaccessible from outside the building when the lock bar means is inserted in and locked in a normal position. The latch means is operable automatically to lock the lock bar means in the normal position when the lock bar means is pushed into its normal position. The latch means is accessible to the interior of the building and operable automatically, when pushed from the inside the building, to release the lock bar means. The releasable fastening means includes a push bar means that protrudes interiorly of the building with only a simple knob portion and is operable to push the latch means to release the guard element.

In preferred embodiments, the releasable fastening means includes an exterior portion of the push bar means that latches under one end of the latch means to lock with positive action the latch into locking engagement with the interior end of the lock bar means and prevent unwanted release. Moreover, in a preferred embodiment the lock bar means engages the latch means at a point at or above the pivotal shaft of the latch means such that a force pulling on the guard element from outside the building tends to pull the latch into more positive engagement with the lock bar means. Yet, the latch means has an overcenter member that allows it to be pushed by either the lock bar for being pushed into normal position or the push bar for being pushed into the release position. Suitable biasing is also provided for most effective operation.

DESCRIPTION OF PREFERRED EMBODIMENTS

Figure 1:
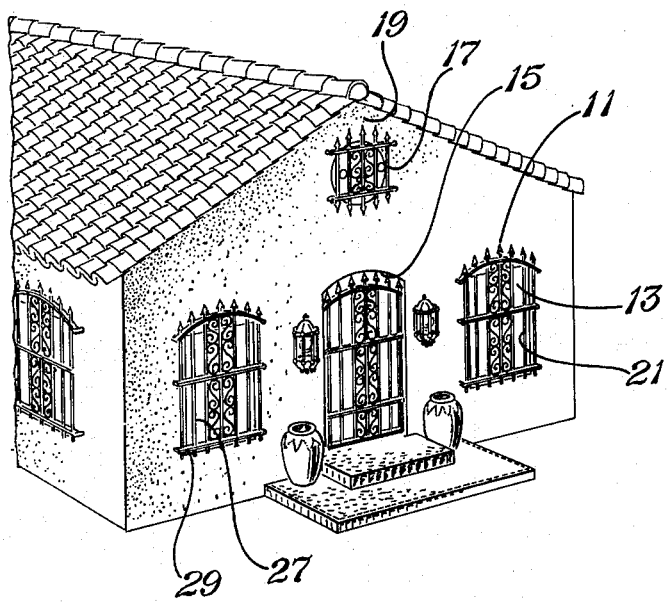
FIG. 1 is a partial isometric view from the front of a house showing guard elements of this invention emplaced over apertures, such as windows, doors and portholes to the attic.
Figure 2:
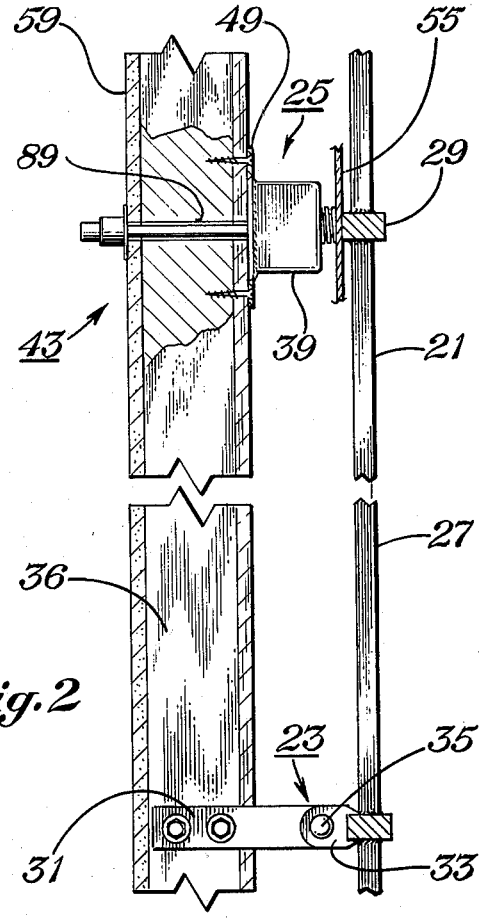
FIG. 2 is a partial side elevational view, partly in section, of an embodiment of FIG. 1, showing the hinged mounted means and the releasable fastening means.

Referring to FIG. 1, the guards 11 are shown and placed over windows 13, doorway 15 and attic porthole 17 of the house 19. The guard, a guard apparatus, 11 comprises a guard element 21; hinged mounting means 23, FIG. 2; and releasable fastening means 25.

The guard element 21 traverses the length and width of the aperture, such as the window 13, and is adapted to prevent entry into the window from the exterior of the building. The guard element 21 may comprise a solid, opaque shield, such as a steel or aluminum shield, that can be decorated on the inside for viewing through the window and blocking out unsightly exterior surroundings; or that can be painted on the outside for suitably decorating old buildings or the like to make them more attractive. Yet, the guard element 21 must have the requisite structural strength to prevent entry into the building to be effective. As illustrated, however, the guard element 21 comprises a decorative grid that prevents entry through the window or the like, and enhances the beauty of the window and building and still allows visibility therethrough. Specifically, the illustrated decorative grid making up the guard element 21 is composed of a plurality of bars 27 and cross pieces 29. The respective bars and cross pieces 27 and 29 are formed of a material designed to prevent entry therethrough. Such a material would ordinarily be metal. Preferably, the bars and cross pieces 27 and 29 are formed of case hardened or high carbon-content steel that cannot be sawed with a backsaw or the like by a person such as burglar, seeking entry into the house 19. Moreover, the bars 27 are close enough together that the human body cannot go between them, thereby preventing uninvited ingress into the house 19. The cross pieces 29 are spaced to prevent bowing of the bars 27 to allow such ingress. The guard element 21 is hingedly mounted by way of the hinged mounting means 23 to allow swinging for proper egress.

The hinged mounting means 23 comprises the building member 31, the guard element member 33 and the hinge shaft 35. The building member 31 is permanently connected to the suitable structure elements such as the wall stud 37 of the house 19. As illustrated, the building member 31 is connected with a stud 36 by way of bolts and nuts (the nuts not being shown since they are located interiorly of the wall and inaccessible to a person either inside or outside the building). Moreover, the heads of the bolts will be suitably covered, as by a window jam, plaster or the like, so as to be inaccessible to a burglar or persons seeking entry through the window. In addition, the building member 31 also is formed of case hardened steel or similar material that cannot be sawed with a hacksaw or the like, similarly as described hereinbefore with respect to the bars and cross pieces 27 and 29.

The guard element member 33 is suitably connected with the guard element formed by the bars 27 and the cross pieces 29 and matingly aligned with the building member 31 so as to be connectable therewith by the hinge shaft 35. Preferably, the guard element member 33 is welded to a cross piece 29, as well as to a bar 27 if immediately adjacent thereto. The guard element member 33, similarly as described with respect to the building member 31, is formed of case hardened steel or the like that cannot be sawed with a hacksaw or a similar tool carried by a burglar or other persons seeking ingress into the house 19.

The hinged shaft 35 is disposed through mating apertures of the building member 31 and the guard element member 33 and serves as a folcum about which the guard element 21 can be pivoted to allow egress by a person inside the house 19. The hinge shaft 35 is irremovably positioned in the respected apertures (not shown). As illustrated, the hinged shaft 35 comprises a case hardened shaft that has a case hardened head on one end and is permanently and fixedly connected with a head on the other end. For example, the head can be enlarged by brading or the like although this may be difficult with case hardened steel. Preferably, a case hardened nut is screwed onto the threads on the end of a case hardened bolt and thereafter welded into place such that it cannot be removed or severed from the bolt.

In any event, the final hinged mounting means 23 is permanently affixed to the walls of the house 19 and adjacent to the window; for example, near the bottom top or one side of the window; and allows pivotal movement of the guard element 21 to open and allow egress of a person from inside the window when the releasable fastening means 25 is released from the interior of the house 19.

The releasable fastening means is connected with the building and the guard element at another of its edges and operable to hold the guard element closed against egress from within or ingress from without into the building in its normal position. The releasable fastening means 25 is releasable by a person interiorly of the building for emergency egress. The releasable fastening means includes a guard element member, similarly as described hereinbefore with respect to the hinged mounting means; a lock bar means 37, FIGS. 3–5; for locking the guard element closed; a lock housing 39; a latch means 41, FIGS. 4 and 5; and push bar means 43 for releasing the guard element.

The lock bar means is provided for locking the guard element into its closed, or normal, position. The lock bar means is connected with the guard element and lockably positionable within the lock housing 39. The lock bar means 37 is formed of case hardened steel or the like that resists sawing with a backsaw similar as described with respect to the other elements hereinbefore. As illustrated, the lock bar means is in the form of a cylindrical bar for insertion within a circular aperture in the lock housing and locking into position. The lock bar means has a shoulder 45 and an adjacent groove 47 at its interior end for being releasably latched in the normal position. If desired, of course, the lock bar means may be of any desired cross sectional shape, such as square. The round shape facilitates forming of the aperture in the lock housing 39.

Figure 3:
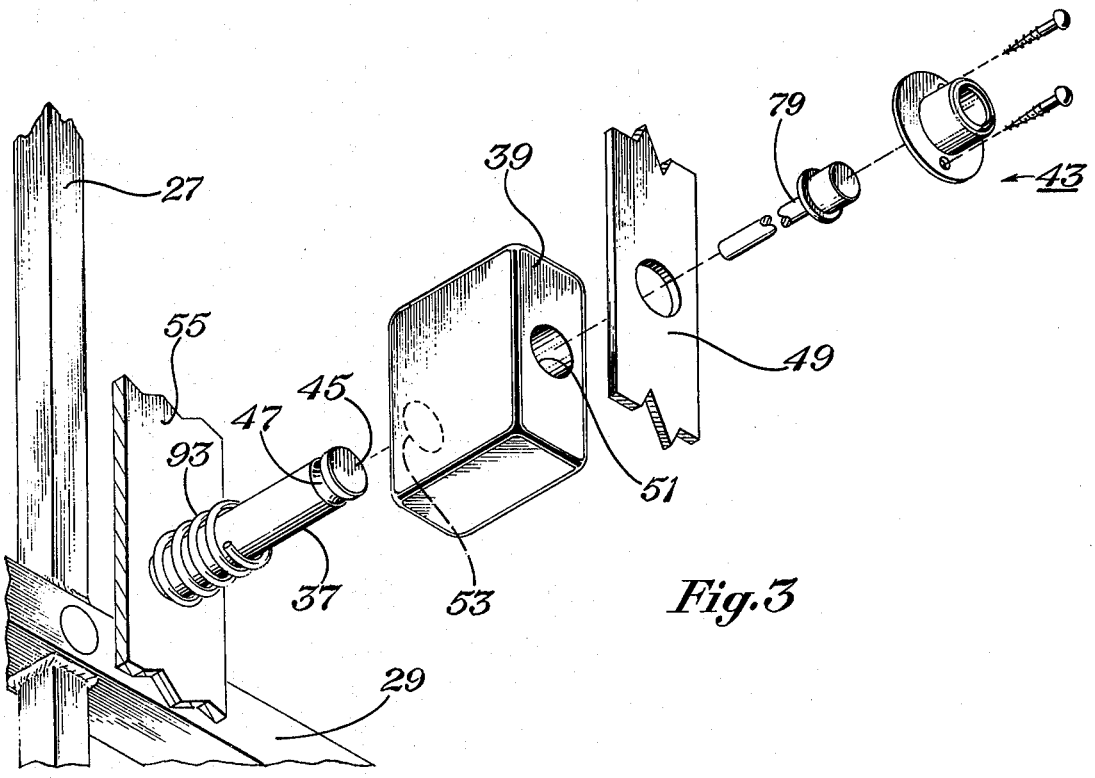
FIG. 3 is a partial exploded isometric view of the releasable fastening means of FIG. 2.
Figure 4:
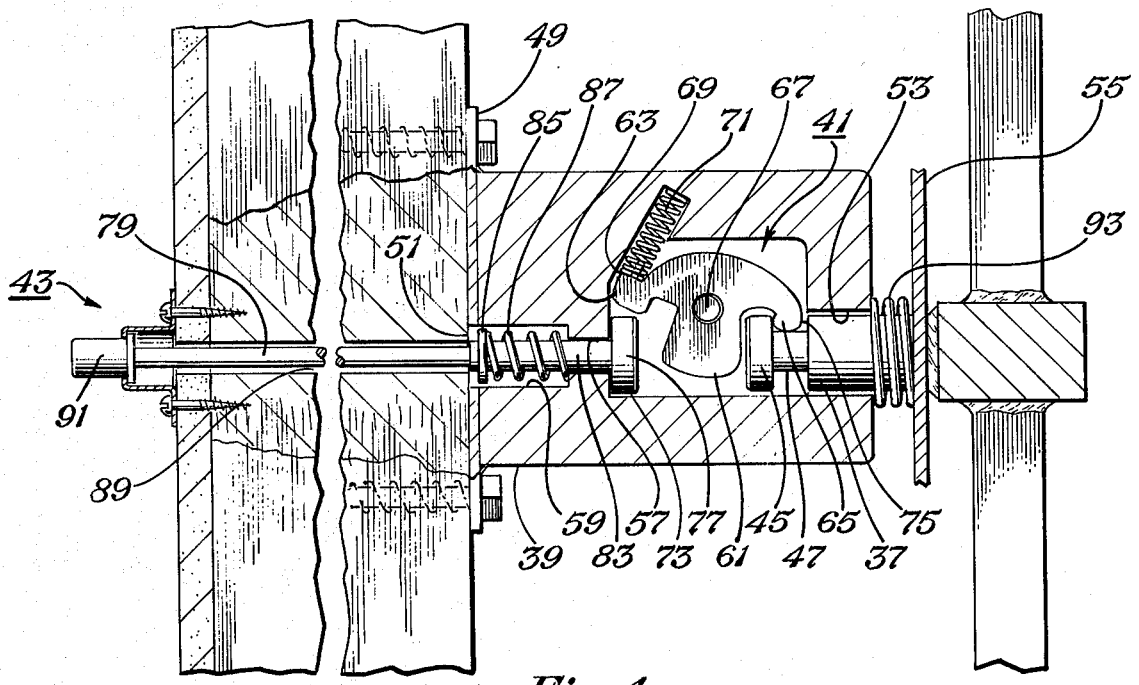
FIG. 4 is a partial side elevational view, partly in section, showing the interior of the lock housing of FIG. 3 in the normal position.

The lock housing 39 is connected with the building 19 as can be seen in FIG. 3, a strap 49 of metal is first connected with the house by way of difficulty removable means, such as one way screws, bolts with inacessible nuts or the like. Thereafter, the housing 39 is connected with a strap 49, as by welding or the like. The housing 39 is made of steel or other material that resists being torn apart by a burglar or the like seeking ingress. Preferably, the housing 39 is formed in a plurality of sections, such as two sections, that can be irreversably joined together after the interior works and suitable apertures are properly formed and assembled. For example, the two halves may be slid together such that when they are welded to the strap 49, they cannot be torn apart by a burglar or the like. If desired, of course, suitable screws or the like can be employed for screwing the portions together, the screws being hidden by being welded to the strap metal or otherwise rendered irremovable by a burglar or the like exteriorly of the building. The housing 39 has a cavity interiorly thereof for housing suitable latch means and other structural elements and has a pair of apertures 51, 53 drilled into the outer housing for conformably receiving, respectively, the push bar means 43 and the lock bar means 37. Preferably the housing is formed of structurally strong cast iron or similar elements that resist attack by burglar tools or the like. Specifically, the aperture 53 is in the form of a passageway of a diameter closely approximating the lock bar means 37 such that the interior latch means is rendered inaccessible to a burglar or the like when the lock bar means is in its normal position.

Further guaranting the lack of excess to the interior of the housing 39 is a lock cover 55. The lockcover is formed of steel or the like and may be affixed, as by welding, to the lug bar means 37. Expressed otherwise, the lock cover 55 moves inwardly and outwardly with the lock bar means and the guard element.

The oppositely disposed aperture 55 consists of a small diameter passageway 57 for receiving a small shaft of the push bar means, as will be discussed hereinafter, and a larger diameter of passageway 59 for conformably receiving the larger diameter portion of the push bar means 43, also as discussed in more detail hereinafter. The respective apertures thus allow access to the latch means 41 interiorly of the housing means 39.

The latch means 41 is provided for locking the lock bar into its normal position. The latch means 41 is inaccessible from outside the building when the lock bar means is inserted in and locked in its normal position. The latch means 41 is automatically operable to lock the lock bar means in the normal position when the lock bar means is pushed into its normal position. The latch means 41 is accessible to the interior of the building and automatically operable when pushed from the inside the building to release the lock bar means. Specifically, the latch means 41 includes a pivotally mounted latch with overcenter and downwardly depending actuating member 61 at the center and respective shoulder engaging latches 63, 65 at each end. The latch means 41 is pivotally mounted about pin shaft 67. The downwardly depending actuating member is somewhat wider at its lower end so as to ensure pivotal movement of the latch means 41 responsive to either the push bar means or the lock bar means 43, 37. As illustrated, the latch means 41 is substantially cymetrical but has a niche 69 for receiving a biasing means 71. The latch 65 for receiving the lock bar means 37 in latching relationship can have, if desired, at its engaging point a squared off portion above the centerline of the pin shaft such that a pulling force on the latch bar means pulls the latch more tightly into locking engagement with the shoulder on the lock bar means 37. However, positive engagement is ensured by the shoulder 73 of the push bar means 43 under the latch end 63. Thus, positive locking is assured to hold the lock bar means 37 in its normal, or locked closed position until the push bar means 43 is pushed from interiorly of the building to release the latch means as will be discussed in more detail hereinafter. The exterior edge of the latch 65 has arcuate construction 75 to allow lifting by ingress of the lock bar means 37.

The biasing means 71, such as a coil spring, serves to bias the latch means 41 to release the lock bar means when the push bar means is pushed from interiorly of the home and the shoulders move from beneath the latch 63. In addition, the push bar means pushes the actuating member 61 to release the lock bar means and allow the guard element to be pushed from the interior of the home to allow emergency egress.

The respective elements of the latch are preferably formed of structurally strong material such as steel, aluminum, or the like. If desired, soft steel or other easily machinable material may be employed since the latch means 41 is not accessible to the exterior for a backsaw or the like. Yet, it will hold the lock bar means until released by the push bar means 43.

Figure 5:
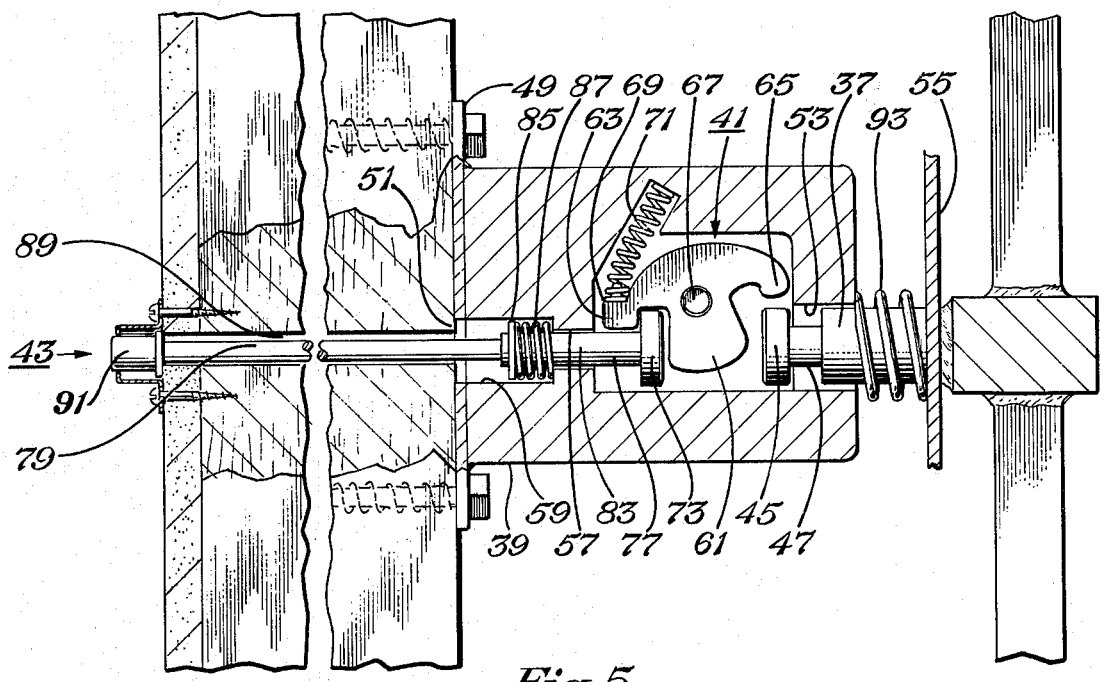
FIG. 5 is a partial side elevational view, partly in section, showing the lock housing of FIG. 4 in the release position.

The push bar means 43 is provided for releasing the lock bar means 37 and ultimately the guard element 21 for emergency egress, as in the case of fire or the like. The push bar means protrudes interiorly of the building and is operable to push the latch means 41 to release the guard element 21. As illustrated, the push bar means comprises a plurality of portions, including an exterior portion 77 and an interior portion 79. The exterior portion 77 has at its exterior end the shoulder 73 for being emplaced under the latch end 63 and ensuring a positive lock holding the lock bar means in place and for pushing on the actuating member 61 of the latch means to positively release the lock bar means. The exterior portion comprises a small diameter shaft 83 that thereby defines a groove adjacent to the shoulder 73 such that the latch end 63 can be emplaced interiorly of the shoulder 73 in the release position, as shown in FIG. 5. The shaft 83 has a retaining washer 85 snapped into a groove therein for holding a spring 87 intermediate the retaining washer 85 and the wall juncture between the small diameter passageway 57 and the larger diameter passageway 59. Spring 87 biases the exterior portion away from the latch means 41 such that when the lock bar means 37 is inserted, it is readily latched into position and the shoulder 73 positively emplaced beneath the latch end 63.

The interior portion 79 comprises a linear shaft emplaced in an aperture 89 in the wall. An enlarged head 91 is provided to facilitate pushing from the interior with low force per unit area, so as to be pushed by the hand or the like.

In operation, the respective bars 27 and cross pieces 29 are assembled by suitable means, as by having the bars penetrate through apertures in the cross pieces and being welded into place. The finished guard element is then connected with the respective guard element members 33 and the lock bar means 37. The building members 31 are emplaced on suitable studs 36. The guard element 21 is thereafter mounted by emplacing the hinge shaft 35 in the apertures through the guard element member 33 and the building member 31 such that the guard element 21 is hingedly mounted to the house 19.

The strap 49 is affixed to the outside wall of the home at an appropriate time. The exact location of the lock housing 39 to such that its aperture 53 will receive the lock bar means 37 is then determined and the lock housing 39 is welded to the strap 49. The aperture 89 is drilled through the interior wall, or otherwise formed so as to align with the aperture 51.

The latch means 41 will have been assembled, along with the exterior portion 77 of the push bar means inside the lock housing before the lock housing is welded to the strap 49. Preferably the exterior portion 79 of the push bar means is then inserted in the aperture 89. The guard element is pushed into place, pushing the lock bar means 37 into its normal position latched closed. If desired, the interior portion of the push bar means 79 can be stored, as by being suspended from a contain rod or the like. Preferably, it is emplaced in the aperture 89 such that it will always be present to facilitate the egress in the event of an emergency. If desired, suitable means may be provided to prevent its removal from the aperture 89.

In the event that emergency egress is desired, the head 91 is pushed by hand, pushing the exterior portion 77. This moves the shoulder 73 from beneath the latch end 63 and pushes the actuating member 61. Once the shoulder 73 is moved from beneath the latch end 63, the biasing means 71 tends to move the latch to release the latch end 65 from the shoulder 45 of the lock bar means. This is further butressed by the positive action of pushing the actuating member 61 to the right by the exterior portion 77 of the push bar means 43. As consequence, the latch 65 releases the shoulder 45 of the push bar means and the push bar is pushed to the right and is now free such that the guard element can be pushed open. If desired, this may be helped by a spring 93 intermediate the lock cover 55 and the lock housing 39. The spring 93 is compressed when the lock bar means is inserted and helps ensure the freeing of the lock bar means when released by movement of the latch means 41 into the released position.

While the guard element 21 has been illustrated as hinged at the bottom and fastened at the top for maximum security for adults, the arrangement is readily varied. For example, it may be hinged at the top to allow easy access to the releasable fastening means 25 by small children. On the other hand, it may be hinged and latched on the side so as to be more easily maintained in the open position for egress by a handicapped person.

The lock bar means has been shown to being welded directly to the guard element 21 with the lock cover 55 in position. If desired, it may be hingedly mounted to a suitable guard element member like the guard member 33. It has been found, however, that one hinged mounting complicates closure following egress. In addition, the hinged mounting means is more expensive for mounting the lock bar means.

From the foregoing, it can be seen that this invention effects the objects delineated hereinbefore and obvious disadvantages of the prior art structures.

Although this invention has been described with a certain interparticularity, it is understood that the present disclosure is made only by way of example and that numerous changes in the details of construction and the combination and arrangement of parts may be resorted to without departing from the spirit and the scope of this invention.

What is claimed is:

1. In a security system having a peripheral structure extending around an area whose access is to be controlled and providing controlled access to the area and having a hingedly mounted guard element traversing an opening allowing at least emergency ingress and egress into and from said area; hinged mounted means hingedly mounting the guard element adjacent one of its ends onto the peripheral structure adjacent said opening for pivotal movement of said guard element outwardly to provide egress through said opening; and releasable fastening means connected with the guard element at its free end and operable to hold the guard element closed against egress from within or ingress from without in a normal position, the improvement; comprising:

a. a lock bar means connected to said guard element and lockably positionable within a lock housing of said releasable fastening means for locking said guard element in its normal closed position;

b. a lock housing that is connected with said peripheral support;

said lock housing having interiorly thereof latch means for locking said lock bar means into its said normal position; said latch means being inaccessible from outside said enclosure when said lock bar means is inserted in and locked in said normal position; said latch means being automatically operable to lock said lock bar means in said normal position when said lock bar means is pushed into said normal position; said latch means being accessible to the interior of said peripheral structure and automatically operable when pushed from inside said peripheral structure to release said lock bar means;

c. push bar means protruding interiorly of said peripheral structure and operable to push said latch means to release said lock bar means and said guard element;

said lock bar means having a shoulder and adjacent groove at its interior end for being releasably latched in said normal position; said push bar means including a portion having a shoulder adjacent its outer end for pushing on said latch means, and, in turn, being held in a released position until said lock bar means is inserted in said normal position; said latch means including an overcenter actuating member and respective shoulder latches at its respective exterior and interior ends for engaging, respectively, said lock bar means in said normal position and said push bar means in said release position.

2. The guard of claim 3 wherein a lock cover is connected with said guard element and operable to further block access to said latch means interiorly of said lock housing when said lock bar means is in said normal position and an outward biasing means is provided intermediate said lock cover and said lock housing for pushing outwardly on said lock cover and, consequently, on said guard element.

3. The guard of claim 1 wherein said latch means has biasing means biasing it into said release position releasing said lock bar means and holding said push bar means; said shoulder on said push bar means being disposed under said interior end of said latch means in said normal position for effecting positive lock of said lock bar means into position.

4. The guard of claim 3 wherein said push bar means comprises two portions, an interior portion extending interior of said building and disposed in a wall aperture for pushing on said latch means to release said lock bar means; and an exterior portion; said exterior portion comprising a small diameter shaft with a shoulder on its exterior end and with a retainer washer on its interior end; a first small diameter passageway encompassing said small shaft and a second and larger diameter passageway encompassing said retainer washer; a spring intermediate said retainer washer in the junction wall intermediate said small and larger passageway and biasing said interior portion away from said latch means so as to retain said shoulder under said interior end of said latch means and lock said lock bar means in said normal position until said spring is depressed by pushing on the first portion of said push bar means to push said latch means into the release position.

* * * * *